US007440842B1

(12) United States Patent
Vorona

(10) Patent No.: US 7,440,842 B1
(45) Date of Patent: Oct. 21, 2008

(54) SYSTEM FOR TRANSMITTING, PROCESSING, RECEIVING, AND DISPLAYING TRAFFIC INFORMATION

(76) Inventor: Dimitri Vorona, 6 Twilight Ct., Livingston, NJ (US) 07039

( * ) Notice: Subject to any disclaimer, the term of this patent is extended or adjusted under 35 U.S.C. 154(b) by 0 days.

(21) Appl. No.: 10/435,348

(22) Filed: May 9, 2003

(51) Int. Cl.
*G08G 1/00* (2006.01)

(52) U.S. Cl. ..... 701/117; 701/119; 701/208; 701/209; 701/211; 340/995.13; 340/995.12; 340/995.19

(58) Field of Classification Search ..... 701/117, 701/119, 208–209, 24, 36, 1, 211; 348/148, 348/149; 340/995.13, 995.12, 995.19
See application file for complete search history.

(56) References Cited

U.S. PATENT DOCUMENTS 4,926,336 A 5/1990 Yamada
5,031,104 A 7/1991 Ikeda et al.
5,428,544 A 6/1995 Shyu
5,539,645 A * 7/1996 Mandhyan et al. ..... 701/119
5,699,056 A 12/1997 Yoshida
5,913,917 A * 6/1999 Murphy ..... 701/123
5,982,298 A * 11/1999 Lappenbusch et al. ..... 340/905
6,097,313 A 8/2000 Takahashi et al.
6,256,577 B1 * 7/2001 Graunke ..... 701/117
6,297,748 B1 * 10/2001 Lappenbusch et al. ..... 340/905
6,334,086 B1 * 12/2001 Park et al. ..... 701/117
6,341,255 B1 * 1/2002 Lapidot ..... 701/209
6,466,862 B1 * 10/2002 DeKock et al. ..... 701/117
6,490,519 B1 * 12/2002 Lapidot et al. ..... 701/117
6,574,548 B2 * 6/2003 DeKock et al. ..... 701/117
6,639,550 B2 * 10/2003 Knockeart et al. ..... 342/357.13
6,650,948 B1 * 11/2003 Atkinson et al. ..... 700/66
6,785,606 B2 * 8/2004 DeKock et al. ..... 701/117
6,868,331 B2 * 3/2005 Hanebrink ..... 701/117
6,873,908 B2 * 3/2005 Petzold et al. ..... 701/210

(Continued)

FOREIGN PATENT DOCUMENTS

DE 60103245 E * 6/2004

(Continued)

OTHER PUBLICATIONS

Microsimulation of Freeway Ramp Merging Processes Under Congested Traffic Conditions; Sarvi, M.; Kuwahara, M.; Intelligent Transportation Systems, IEEE Transactions on; vol. 8, Issue 3, Sep. 2007 pp. 470-479; Digital Object Identifier 10.1109/TITS.2007.895305.*

(Continued)

*Primary Examiner*—Cuong H Nguyen
(74) *Attorney, Agent, or Firm*—Ward & Olivo

(57) ABSTRACT

A system for sharing and processing traffic information includes a number of traffic information computer systems within individual vehicles and a traffic information server system. The traffic information computer systems are each connected to the server system through a network, which are additionally connected to one another by peer-to-peer radio communications, and which each operate with a database for displaying road maps, with a database storing average speed data for directions of travel along roadways, and with a location sensor used to determine the location and average speed of the vehicle, which are transmitted to the server. The server returns average speed data for road segments, which is displayed on the road maps.

16 Claims, 12 Drawing Sheets

| SEG CODE | AVG SPEED | NORM SPEED | COLOR CODE | TIME | SPEED | TIME | SPEED |
|---|---|---|---|---|---|---|---|
| 0001 | 45 | 45 | G | 145 | 41 | 141 | 38 |
| 0002 | 38 | 45 | Y | 131 | 32 | 132 | 28 |
| 0003 | 20 | 45 | R | 138 | 15 | 146 | 22 |
| 0004 | 45 | 45 | G | 145 | 45 | 139' | 39 |

U.S. PATENT DOCUMENTS

| | | | | |
|---|---|---|---|---|
| 6,889,137 | B1 * | 5/2005 | Rychlak | 701/209 |
| 6,911,918 | B2 * | 6/2005 | Chen | 340/995.13 |
| 2001/0029425 | A1 | 10/2001 | Myr | |
| 2001/0056325 | A1 | 12/2001 | Pu et al. | |
| 2002/0072963 | A1 * | 6/2002 | Jonge | 705/13 |
| 2002/0077741 | A1 * | 6/2002 | Hanebrink | 701/117 |
| 2002/0161518 | A1 * | 10/2002 | Petzold et al. | 701/210 |
| 2002/0193938 | A1 * | 12/2002 | DeKock et al. | 701/117 |
| 2003/0069683 | A1 * | 4/2003 | Lapidot et al. | 701/117 |
| 2003/0225516 | A1 * | 12/2003 | DeKock et al. | 701/214 |
| 2004/0119612 | A1 * | 6/2004 | Chen | 340/995.13 |

FOREIGN PATENT DOCUMENTS

| | | | | |
|---|---|---|---|---|
| EP | 1241650 | A1 | * | 9/2002 |
| JP | 2006184232 | A | * | 7/2006 |
| JP | 2007057468 | A | * | 3/2007 |

OTHER PUBLICATIONS

Location-Aware Services over Vehicular Ad-Hoc Networks using Car-to-Car Communication; Dikaiakos, M.D.; Florides, A.; Nadeem, T.; Iftode, L.; Selected Areas in Communications, IEEE Journal on; vol. 25, Issue 8, Oct. 2007 pp. 1590-1602; Digital Object Identifier 10.1109/JSAC.2007.071008.*

Statistical profile generation for traffic monitoring using real-time UAV based video data; Puri, A.; Valavanis, K.P.; Kontitsis, M.; Control & Automation, 2007. MED '07. Mediterranean Conference on; Jun. 27-29, 2007 pp. 1-6; Digital Object Identifier 10.1109/MED.2007.4433658.*

The research on drivers' route choice behavior in the presence of dynamic traffic information; Yuanfeng Zhou; Jianping Wu; Intelligent Transportation Systems Conference, 2006. ITSC '06. IEEE; 2006 pp. 1304-1309; Digital Object Identifier 10.1109/ITSC.2006.1707403.*

Using ITS data fusion to examine traffic dynamics on a freeway with variable speed limits; Bertini, R.L.; Boice, S.; Bogenberger, K.; Intelligent Transportation Systems, 2005. Proceedings. 2005 IEEE; Sep. 13-15, 2005 pp. 1006-1011; Digital Object Identifier 10.1109/ITSC.2005.1520188.*

Probe vehicle sampling for real-time traffic data collection; Wang Li; Wang Chuanjiu; Shen Xiaorong; Fan Yuezu; Intelligent Transportation Systems, 2005. Proceedings. 2005 IEEE; Sep. 13-15, 2005 pp. 222-224; Digital Object Identifier 10.1109/ITSC.2005.1520167.*

Segment based traffic information estimation method using cellular network data; Hsiao, W.C.M.; Chang, S.K.J.; Intelligent Transportation Systems, 2005. Proceedings. 2005 IEEE; Sep. 13-15, 2005 pp. 142-147; Digital Object Identifier 10.1109/ITSC.2005.1520020.*

* cited by examiner

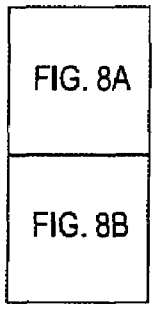
FIG. 8
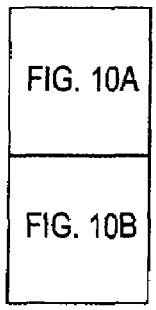
FIG. 10
230 238 240 242 244 248 248 246 248
| SEG CODE | AVG SPEED | NORM SPEED | COLOR CODE | TIME | SPEED | TIME | SPEED |
|---|---|---|---|---|---|---|---|
| 0001 | 45 | 45 | G | 145 | 41 | 141 | 38 |
| 0002 | 38 | 45 | Y | 131 | 32 | 132 | 28 |
| 0003 | 20 | 45 | R | 138 | 15 | 146 | 22 |
| 0004 | 45 | 45 | G | 145 | 45 | 139` | 39 |
238 234 236
FIG. 9

SYSTEM FOR TRANSMITTING, PROCESSING, RECEIVING, AND DISPLAYING TRAFFIC INFORMATION

BACKGROUND OF THE INVENTION

1. Field of the Invention

This invention relates to communicating traffic information between a number of vehicles and a server computer, to storing and processing the information within the server computer system, and to providing for the display of the traffic information on a display screen within each of the vehicles.

2. Summary of the Background Art

A number of vehicles are equipped with car navigation systems using GPS (Global Positioning Systems) systems to derive the location of the vehicle from signals transmitted by satellites. A car navigation system also includes a display screen and a database providing map data used within the system to generate maps of roads within the region in which the vehicle is operating. The position data and the map data are used together to derive the position of the vehicle on a road, which is then displayed, along with surrounding roads, on the display screen. The map data is generally provided to the system in the form of read-only data recorded on one or more compact disks.

The patent literature includes a number of patents describing methods for adding traffic data to the information displayed by a car navigation system on a real time basis. For example, U.S. Pat. No. 5,699,056 describes a traffic information system including a number of vehicles in radio communication with a center. In one embodiment of the system, the presence or absence of a traffic jam is determined within the center based on only information automatically transmitted to the center from apparatus on the vehicles. A car navigation system on each of the vehicles performs as a position sensor, giving the position of the vehicle. Each of the vehicles is connected to the center through a radio network including a number of repeaters located throughout a region. The information transmitted to the center includes at least a vehicle identifier, time data, and position data. An information processor in the on-board apparatus in each vehicle transmits this information at least twice at suitable time intervals. Using data transmitted from a number of vehicles, the center calculates an average vehicle speed for each block forming a portion of a road within a region supervised by the center and determines that a traffic jam has occurred within the block if the average vehicle speed is less than a predetermined value. The number of vehicles within the block may also be considered in this determination, and the average vehicle speed may be additionally used to determine the severity of a traffic jam in a block. Information identifying the traffic jam and its location is transmitted from the center to vehicles, to be displayed at corresponding locations on the displayed maps.

Other versions of the traffic information system of U.S. Pat. No. 5,699,056 include the use of instrumentation on the vehicles to determine road and weather conditions and to measure the shapes of other vehicles, so that information that is more extensive is transmitted to the center and returned to the vehicles. What is needed is a traffic information system providing communications among a very large number of vehicles within a large region and a center without a need to build a specialized radio network including a large number of repeaters to cover the distances involved. Additionally, what is needed is a communication system operating in an efficient manner so that thousands of vehicles can communicate with a center without jamming the associated radio frequencies.

U.S. Pat. App. Pub. No. 2001/0029425 describes a system providing vehicle guidance by a central traffic unit maintaining a perpetually updated database of travel times for all sections of roads. Mobile guidance units within the vehicles include mobile cell phone handset units located in mounting receptacles and communicatively linked to the central traffic unit computer server. To detect a bottleneck situation as it arises, and to estimate travel times for a section of road, the central traffic unit maintains a list of vehicles that have recently exited that section. If the times those vehicles have spent in the section differ substantially from a regular travel time stored in a database, the central traffic unit uses statistical tools for forecasting a future travel time along the section.

In response to a request from a driver for a route update from his present position to a desired destination, communicated via mobile phone to the central traffic unit, the central traffic unit calculates the desired fastest route by utilizing both the regular travel times along segments of the roads and predicted current travel times calculated using information collected from the vehicles. The fastest route is then communicated to the guidance unit for display on a computer screen.

The mobile guidance units within the vehicles passively collect traffic information as they travel. A circuit card within the mobile guidance unit causes the mobile cell phone handset unit to transmit real time position data via a mobile telephone transmission protocol. A client of the guidance system may enter a navigation query via a network service through a voice processor in the central traffic unit. The mobile guidance unit in a vehicle can be used to transmit a request in a PC Internet/WAP software application, with the request being transmitted through a telecommunications network to an Internet/WAP server. The navigation directions are returned by TCP/IP protocol in terms of digital map and text/voice driving instructions. Other potential users and trip planners access the an on-line guidance system through Internet browsers, receiving a description of a shortest path solution between starting and destination points.

U.S. Pat. App. Pub. No. 2001/0056325 describes a client navigation system in an automobile that establishes a wireless connection to a navigation server on a computer network, such as the Internet, requesting a route by uploading start and stop specifications. The server calculates an optimal route based on real-time data available on a network and transmits route information to the client navigation system, which interprets the route, interfaces with a local mapping database, and reconstructs the optimal route.

U.S. Pat. No. 5,425,544 describes a method and apparatus for the transfer of traffic information among vehicles and for assisting the navigation of the vehicles. The traffic information is routinely and automatically transmitted between vehicles passing on a highway. The apparatus includes sensors to detect the direction and displacement of the vehicle, a microcomputer to recognize the position of the vehicle by referring the detected direction and displacement to a digitized map; a receiver to receive the passing vehicle's traffic information to be process by the microcomputer; a transmitter to transmit traffic information to the passing vehicle; and a navigation unit in the microcomputer to generate navigation information. The traffic information transferred among vehicles includes traffic information generated in the vehicles themselves and traffic information received from other vehicles.

SUMMARY OF THE INVENTION

It is a first objective of the invention to provide a system for receiving average traffic speed data for various road segments, within a computer system in a vehicle, and for displaying this average traffic speed data on a roadmap display on the computer system.

It is another objective of the invention to transmit traffic data from a computer system within a vehicle to a server system over a network and to receive average traffic data values from the server system over the network while minimizing usage of the network.

It is a further objective of the invention to provide a traffic information system using peer-to-peer communications between vehicles when a vehicle cannot contact a server system.

According to a first aspect of the invention, a system is provided for communicating and processing traffic information among a number of vehicles and a base station. Within the base station, the system includes a traffic information server and a first database storing traffic data. The traffic information server includes a processor programmed to receive traffic data from a vehicle within the plurality of vehicles, to store the traffic data received from the vehicle within the first database, to calculate average data values from traffic data stored within the first database, and to transmit a portion of the average data values to a vehicle within the plurality of vehicles. The system also includes a communication network connecting each of the vehicles with the traffic information server.

Within each of the vehicles, the system includes first and second transceivers, a location sensor, a second database, and a traffic information computer. The first transceiver is for connecting with the communication network to transmit the traffic data and to receive the portion of average data values. The location sensor determines a geographic location of the vehicle. The second database stores average data values. The second transceiver is for transmitting the average data values to another vehicle and for receiving the average data values from another vehicle within the number of vehicles. The traffic information computer includes a microprocessor programmed to determine the traffic data from geographic location data received from the location sensor, to transmit the traffic data determined from data received from the location sensor over the communication network to the traffic information server, to receive the average data values over the communication network from the traffic information server, and to transmit and receive the traffic data values from another vehicle within the plurality of vehicles through the second transceiver.

According to another aspect of the invention, a traffic information computer system is provided. The traffic information computer system includes data storage, a display screen, a first transceiver, and a processor. The data storage stores a mapping database holding data for generating roadmaps and a traffic database storing average speed data for road segments. The processor is programmed to generate roadmaps from data held within the mapping database, to display the roadmaps on the display screen, to receive average speed data for road segments through the first transceiver, to store the average speed data for road segments received through the first transceiver to the traffic database, and to display portions of the average speed data for road segments stored within the traffic database in locations corresponding to the road segments on the display screen.

According to yet another aspect of the invention, a traffic information server system is provided. The server system includes a server computer and a database. The server computer has an interface for communicating over a network and includes a processor. The database, which is accessed by a server computer, storing traffic data including average data values. The processor within the server computer is programmed to receive a call from a client system, to receive the traffic data from the client system in response to receiving the call, to transmit a portion of the average data values to the client system in response to receiving the traffic data before the call from the client system is terminated, to store the traffic data received from the client system within the database, and to calculate the average data values from the traffic data stored within the database.

BRIEF DESCRIPTION OF THE DRAWINGS

FIG. 9 is a pictographic view of a data structure in a database accessed by a traffic data server within the traffic information system of FIG. 1.

DETAILED DESCRIPTION OF THE INVENTION

Figure 1:
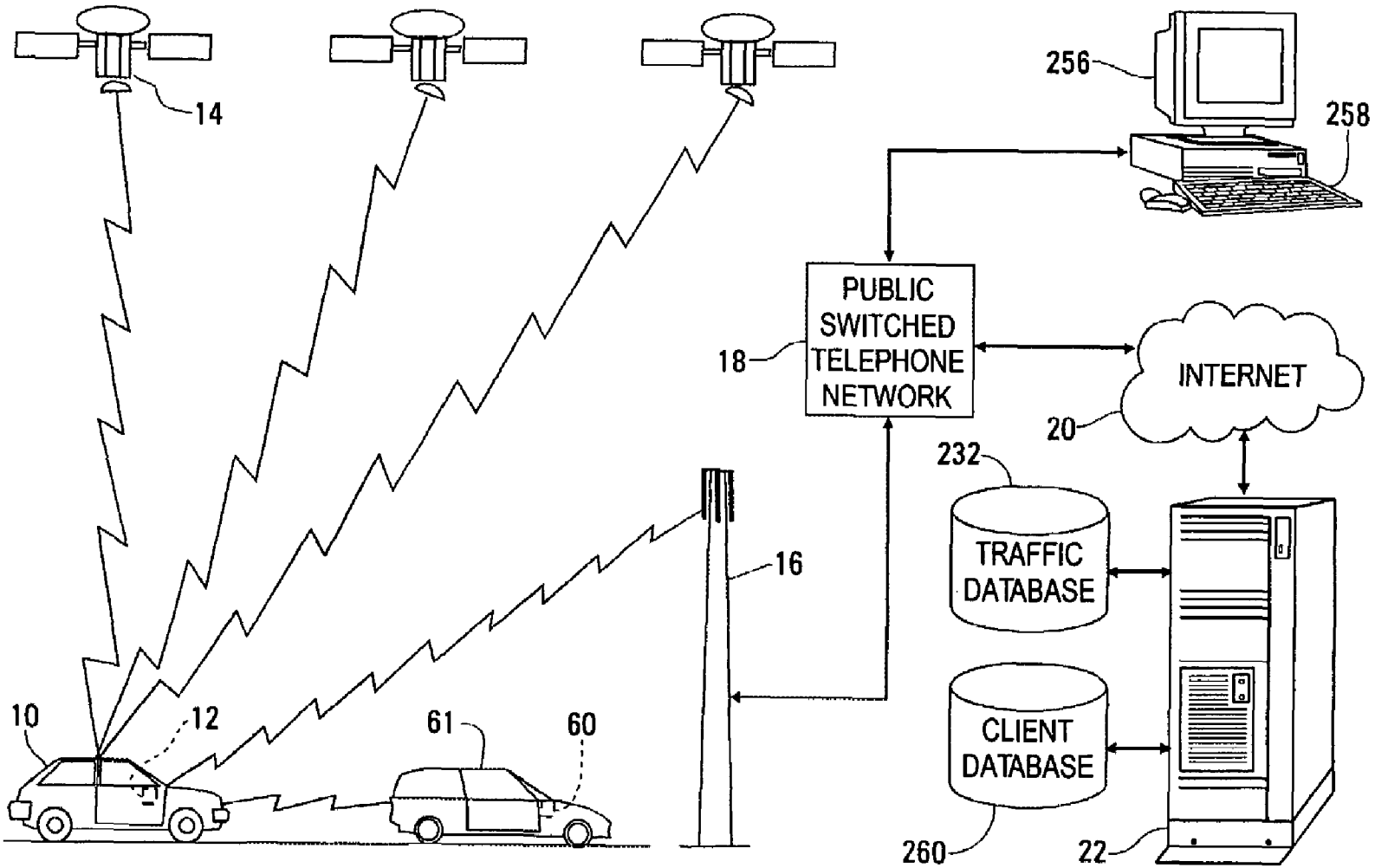
FIG. 1 is a block diagram of a traffic information system in accordance with the invention.

FIG. 1 is a block diagram of a traffic information system in accordance with the invention. During operation of the system, a vehicle 10, equipped with a traffic information computer 12, receives data on its geographical position from a number of GPS satellites 14. For accurate results, radio signals from three such satellites 14 are used. The traffic information client 12 is also provided with cellular telephone communications through a number of conventional cellular towers 16 to the public switched telephone network 18, and then through the Internet 20 to a traffic information server 22.

Figure 2:
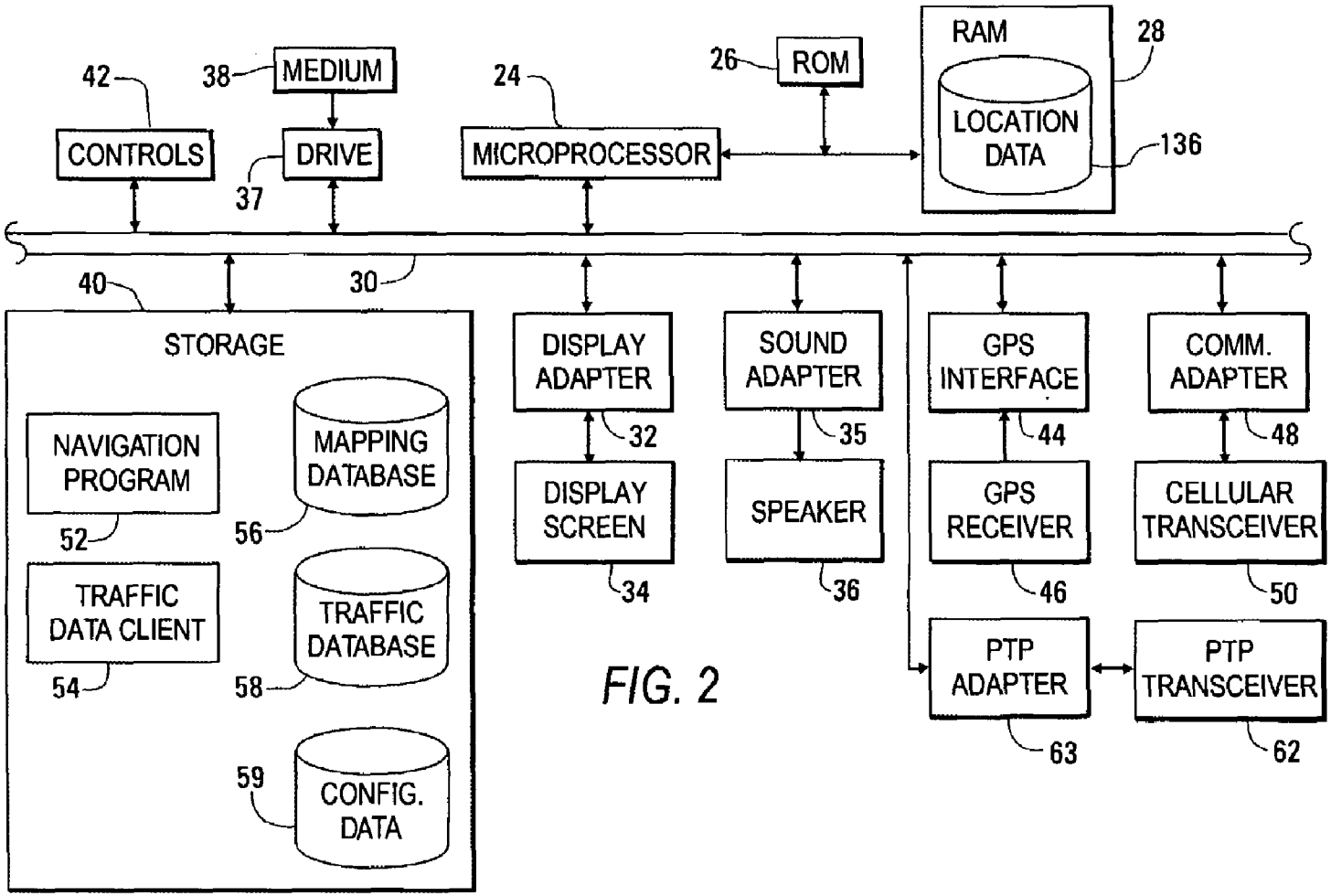
FIG. 2 is a block diagram of a traffic information computer built in accordance with the invention for operation within the traffic information system of FIG. 1.

FIG. 2 is a block diagram of the traffic information computer 12, which includes a microprocessor 24 connected to a read-only memory 26, a random access memory 28, and a bus 30. Various elements are connected to the bus 30 to receive and provide electrical signals. These elements include a display adapter 32 driving a display screen 34, a sound adapter 35 driving a speaker 36, a drive unit 37 reading a storage medium 38, data and instruction storage 40, controls 42 forming part of a user interface. These elements also include a GPS interface 44 connected to the GPS receiver 46 receiving radio signals from the GPS satellites 14 (shown in FIG. 1), and a communications adapter 48 driving a cellular transceiver 50 to transmit information to, and to receive information from, a cellular telephone network through cellular towers 16 (also shown in FIG. 1). Data and instruction storage 40 is, for example, a hard disk drive or a flash memory including instruction storage storing a navigation subroutine 52 and a traffic data client subroutine 54, and data storage storing a mapping database 56 and a traffic database 58. Preferably, the data and instruction storage 40 additionally includes a configuration data structure 59 storing settings controlling operation of the computer 12. These settings may be stored as default values during the initial loading of program information or as updated values supplied by actions of the user.

During operation of the traffic information computer 12, instructions and data are loaded from storage 40 into RAM 28 for execution of the instructions within the microprocessor 24. The microprocessor 24 also executes program instructions stored in ROM 26. Instructions and data may be loaded into storage 40 from a computer readable medium 38 through the drive unit 37. For example, the medium 38 may be a compact disk, while the drive unit 37 is a device for reading such a medium. Alternatively or additionally, instructions and data may be loaded into storage 40 through cellular telephone transmissions through the cellular transceiver 50 and the communications adapter.

In accordance with a preferred version of the invention, the traffic information computer 12 is additionally provided with a capability for communicating with a second traffic information computer 60 in a second vehicle 61 on a direct, peer-to-peer basis, without the use of cellular towers 16 or the traffic server 22. To this end, a peer-to-peer radio transceiver 62 is connected to the bus 30 through a peer-to-peer adapter 63. For example, the peer-to-peer radio transceiver 60*b* may transmit and receive data on one of the frequencies described in the IEEE 802.11 specifications. Peer-to-peer communications can be used to obtain traffic data from another vehicle 60*a* having the traffic data stored in its traffic information 60 in the event that communication cannot be established with a cellular tower 16.

While the use of cellular communications and of the Internet 20, it is understood that other systems, such as the wireless application protocol (WAP) and the Global System for Mobile Communications (GSM) may alternately be used to establish a wireless network for vehicles 10 communicating with the server 22.

Figure 3:
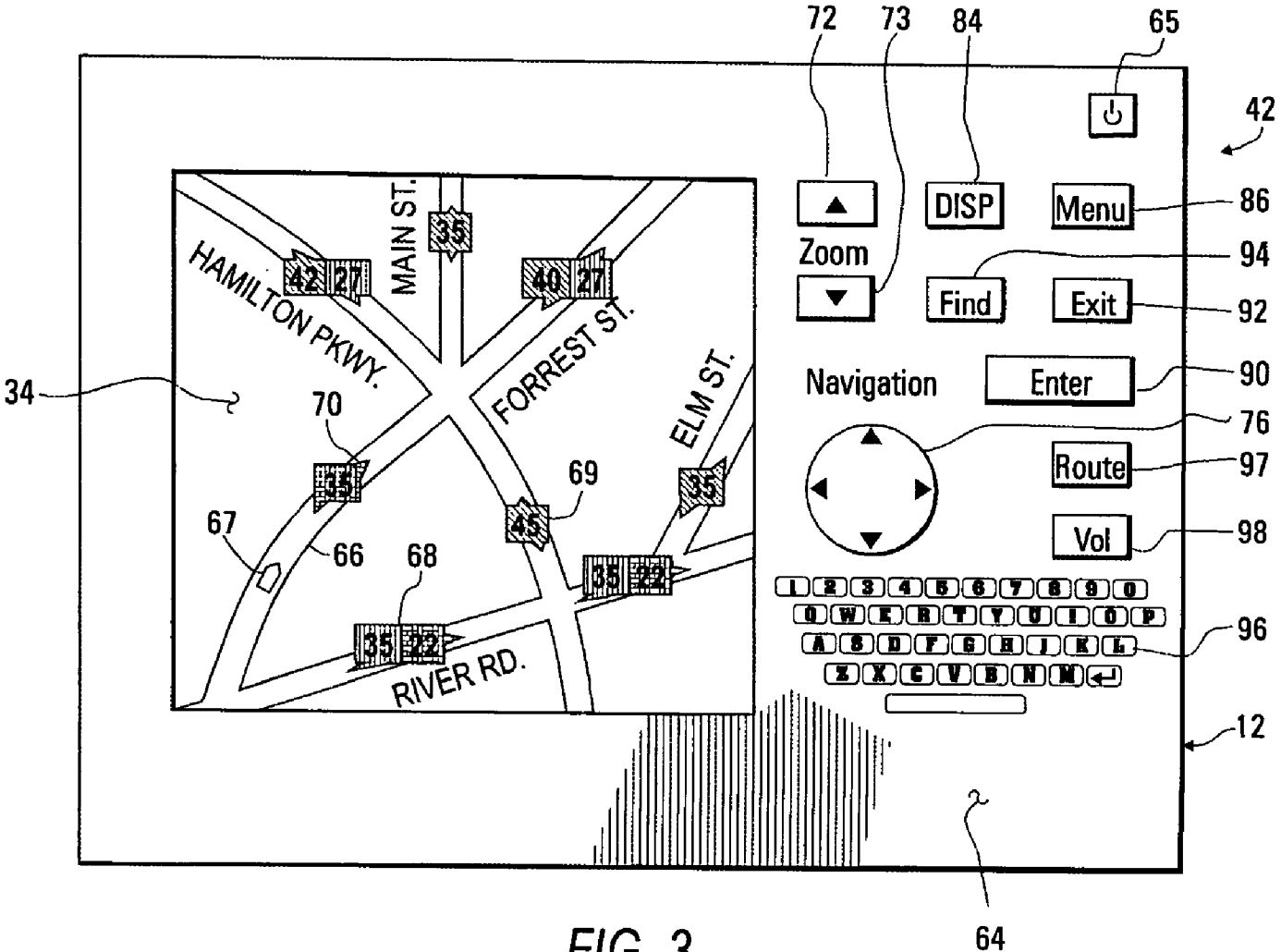
FIG. 3 is a front elevation of the traffic information computer of FIG. 2.

FIG. 3 is a front elevation of the traffic information computer 12 within the automobile 10, forming a part of the traffic information system 10 shown in FIG. 1. In particular FIG. 3 shows various elements of the user interface of the traffic information computer 12, including the display screen 34 and controls 42, extending from a front cover 64 as buttons to be depressed. Operation of the computer system 12 is started and ended by pushing the power button 65, which toggles between "on" and "off" conditions.

Referring to FIGS. 1-3, the navigation subroutine 52 operates as a conventional car navigation program, using data obtained through the GPS receiver 46 to determine the location of the vehicle 10, and additionally using map data from the mapping database 56 to generate a road display pattern 66, on the display screen 34, of roads in an area surrounding the location of the vehicle 10. The navigation program additionally causes an arrow 67, representing the vehicle 10 and the direction in which it is facing, to be displayed on one of the roads in the road display 62 at a location corresponding to the location of the vehicle 10, as determined through the GPS receiver 46. The direction in which the vehicle 10 is facing is determined form the output of the GPS receiver 46, from a magnetic compass reading, or, alternately by comparing two or more locations to determine a direction of motion.

In accordance with the present invention, the traffic data client subroutine 54 uses the communication adapter 48 and the cellular transceiver 50 to communicate with the traffic data server 22. The vehicle 10 acts as a probe vehicle for the traffic data server 22, with the data client subroutine 54 additionally reporting data indicating the average speed of the vehicle 10 over a section of road along which the vehicle 10 is moving. The traffic data server 22 receives and stores this speed data received from the vehicle 10 and from a number of other vehicles. The traffic data client subroutine 54 also requests data to be provided by the traffic data server 22 regarding the average speed at which vehicles are traveling on roadways in the vicinity of the vehicle 10. After receiving such data from the traffic data server 22, the traffic data client subroutine 54 writes the speed data to the traffic database 58.

Further in accordance with the invention, each road within a number of roads in a geographic region for which the traffic data server 22 provides information is divided into a number of segments. For example, such a geographic region may be a city, a metropolitan area, a state or province, or a country. Traffic data is reported to the traffic data server 22 according to vehicle movements in each of these segments and is stored by the server 22 in data locations corresponding to these segments.

The navigation subroutine 52 reads data from the traffic database 58 and causes the data to be displayed on the display screen 34 in a number of data boxes 68, 69 at locations on the road display pattern 62 corresponding to the segments of roads for which data is being displayed. If the average vehicle data speed is determined to be significantly different in the two directions of travel along the road segment, two values are shown in a split data box 68. If the average vehicle data speed is determined not to be significantly different in the two directions of travel, a single value may be shown in a single-value data box 69. For example, a difference of less than five miles per hour may not be considered significant. In any case, the data boxes 68, 69 may be modified to include pointers 70 indicating a direction of travel corresponding to the adjacent displayed value of average vehicle speed. The vehicle speeds are preferably displayed in miles per hour or in kilometers per hour.

Preferably, the data boxes 68, 69 are colored to indicate a relationship between the average speed of traffic and a normal traffic speed, which may be calculated using the speed limit of the particular road segment, modified by delays associated with traffic lights under light traffic or normal traffic conditions. For example, if the traffic is flowing at 80 percent or more of the normal speed, the associated data box 68, 69 is displayed with a green background. If the traffic is flowing between 50 and 80 percent of the normal speed, the associated data box 68, 69 is displayed with a yellow background. If the traffic is flowing at less than 50 percent of the normal speed, the associated data box 68, 69 is displayed with a red background. A split data box may have display different colors on its two sides.

Figure 4:
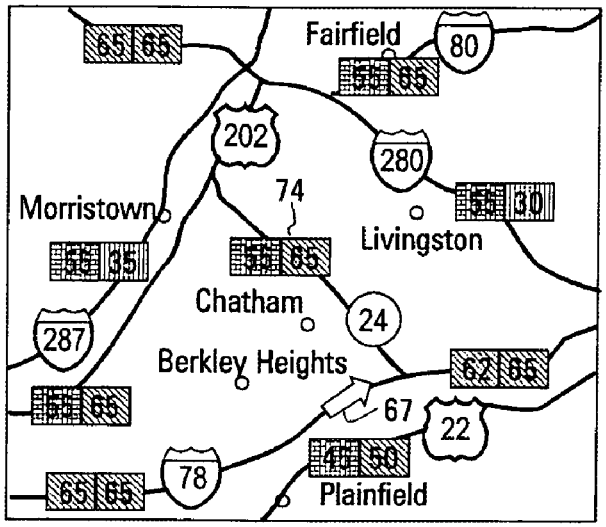
FIG. 4 is a view of a large area as displayed on the traffic information computer of FIG. 2.

According to a preferred version of the invention, the display screen 34 displays two or more levels of detail, with FIG. 3 being exemplary of the highest level of detail, showing every public road or every commonly traveled road in a relatively small area. FIG. 4 is a displayed view of a much larger area, such as a region including several towns, with traffic data being given only for major highways. The user is able to move between these kinds of views or among several levels of detail, by using the zoom buttons 72, 73. The upward pointing zoom button increases magnification, driving the system toward a more detailed display, while the downward pointing zoom button 73 decreases magnification, driving the system toward displaying a larger area. FIG. 4 also shows a variation in the display of average speed data, with the direction of travel associated with an average speed being indicated by the relative position of the data boxes 74, without the use of pointers 70, as shown in FIG. 3. With this method, the speed of traffic going in the direction of the driver is shown in the right side of the data box, while the speed of traffic going opposite the direction of the driver is shown in the left side of the data box. In areas where people conventionally drive on the left side of the road, these directions may be reversed, with the speed of traffic going in the direction of the driver being shown in the left side of the data box. This method is preferably continued across the map, with an assumption being implied that the driver will not turn around or double back.

On either type of display, the location of the vehicle 10 and its direction of orientation is indicated by an arrow 67, which moves along the displayed map with motion of the vehicle. The view shown by the map also moves, at least in a manner sufficient to keep the arrow 67 visible within the display, and preferably in a manner keeping the arrow near a fixed location, such as the center of the display. The navigation control 76 is also used to change the display of the map. For example, if the upper edge of the navigation control 76 is depressed, the displayed map is moved downward, showing more roads and traffic conditions above, or to the north of, the presently displayed area.

For example, the navigation control 76 is implemented using a plastic disk extending above four switches, located at positions corresponding to the cardinal points of the compass (north, south, east, and west). If the disk is depressed in an intermediate position, two of the switches are operated. For example, it the disk is depressed in a northwest position, the switches corresponding to the north and west positions are both operated, so that the map is moved to show more roads and traffic conditions toward the northwest.

Figure 5:
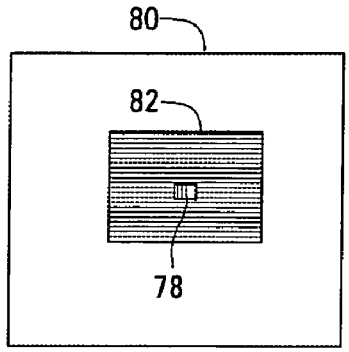
FIG. 5 is a pictographic view of a geographic region in which a vehicle within the traffic data system of FIG. 1 is traveling.

FIG. 5 is a pictographic view of the geographic region in which the vehicle 10 is traveling. When the display is showing the greatest level of detail, as in the example of FIG. 3, only a small region 78 is displayed on the screen 34. When the display is showing the greatest area, as in the example of FIG. 4, a must larger region 80 is displayed. Preferably, the traffic database 58 (shown in FIG. 2) holds detailed traffic data (i.e. average speed data) for the roads within an intermediate region 82 that is significantly larger than the region 78 currently being displayed. This allows the region being displayed to be changed in response to movement of the vehicle 10 and additionally in response to use of the navigation control 76, with new traffic data being rapidly displayed. Preferably, the traffic database 58 also holds traffic data for the major roads, as shown in FIG. 4, for the much larger region 80, so that such data can be rapidly displayed for this region in response to the use of one of the zoom controls 72. Traffic data for major roads may in fact be stored for several adjacent larger regions. On the other hand, the mapping database 56 preferably stores detailed mapping data for a region much larger than the intermediate region 82, and perhaps even large than the region 80.

Preferably, the traffic data computer 12 has an ability to display data in several forms, including the highly detailed view described above in reference to FIG. 3 and the wide area view described above in reference to FIG. 4. For example, data may be displayed in several intermediate views, covering a smaller area than the wide area view of FIG. 4 and having less detail than the highly detailed view of FIG. 3. Traffic data may alternately be displayed in a list form, having a number of roads listed with their average speeds in each direction. A display control 84 is provided in the form of a button that can be depressed to cause the computer 12 to step through the various available display modes.

The traffic data computer 12 preferably uses a menu-driven process to change settings determining how the system is operated, with data describing the settings being stored in the configuration data structure 59. Access to the menu-driven process is achieved by depressing the menu button 86.

Figure 6:
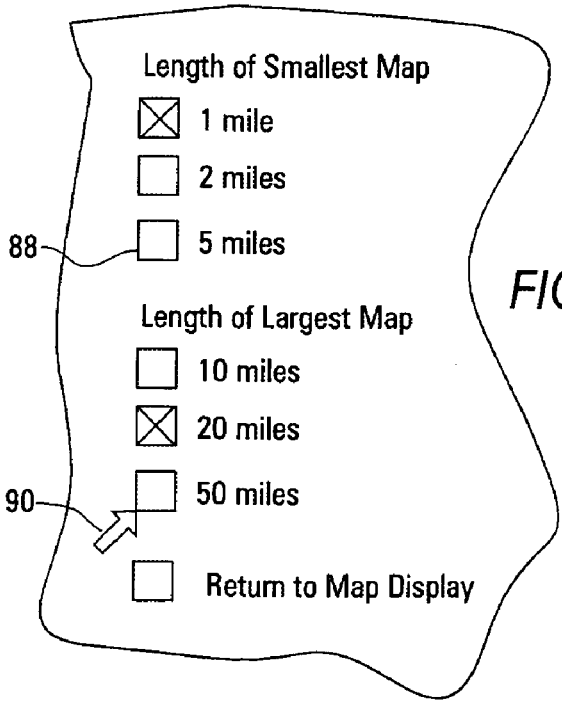
FIG. 6 is a fragmentary view of menu data displayed on the screen of the traffic information computer of FIG. 2.

FIG. 6 is a fragmentary view of menu data displayed on the screen 34 in response to depressing the menu button 86. This data includes a number of checkboxes 88 that may be selected by the user with the controls 42. For example, the user moves a curser 90 displayed as an arrow upward and downward among the various check boxes 88 by repeatedly depressing the zoom buttons 72. When he reaches a selection he wishes to make, he depresses the enter button 90, causing a marking to appear in the checkbox selected as marking in other checkboxes conflicting with this selection are cleared. As such changes are made, the selections are stored by writing data to the configuration data structure 59 (shown in FIG. 2). When the user is finished using the menu, he depresses the exit button 92 to return the system to a map display.

Continuing to refer to FIGS. 2 and 3, according to one version of the invention, the traffic data computer 12 additionally includes a feature providing for locating an address supplied by the user on the maps that can be displayed on the screen 34 and for plotting a route along the displayed roadways between the present location of the vehicle 10 and the location of the supplied address. To use this feature to find an address, the user depresses the find button 94 and then types the desired address on the keyboard 96. When he has finished entering the address, he presses the enter button 90. The system then shows a map including the address supplied, with the location of the address highlighted or otherwise indicated with an icon. To use this feature to determine a route, the user depresses the route button 97 before entering the address on the keyboard 96. The system then shows a map with a route selected by the system highlighted. The user may use the zoom, navigate, and DISP controls to examine the surroundings of the selected location entered using the keyboard 96 or the route between his present location and this selected location.

The traffic data computer may also include a feature providing audio capabilities. For example, if the user is driving the vehicle 10 along a route chosen by the system, an audio message provided through the sound adapter 35 and the speaker 36 may give an audio indication, using synthesized speech, when he is approaching a point in which he has to turn to stay on the route. The system may also provide an audio i in which the traffic data indication that the vehicle 10 is approaching an area in which traffic data indicates there is slow moving traffic. If this feature is provided, a volume control button 98 is used to determine the volume of the audio messages. For example, the volume control button 98 is repeatedly depressed to step through six levels of increasing audio volume, with an additional depression of the button 98 returning to the lowest level to repeat the process.

Figure 7:
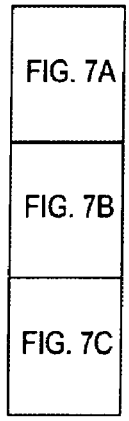
FIG. 7 is a flow chart of a process occurring within the traffic information computer of FIG. 2 during execution of a navigation program, including an upper portion indicated as FIG. 7A, a central portion indicated as FIG. 7B, and a lower portion indicated as FIG. 7C.
Figure 7A:
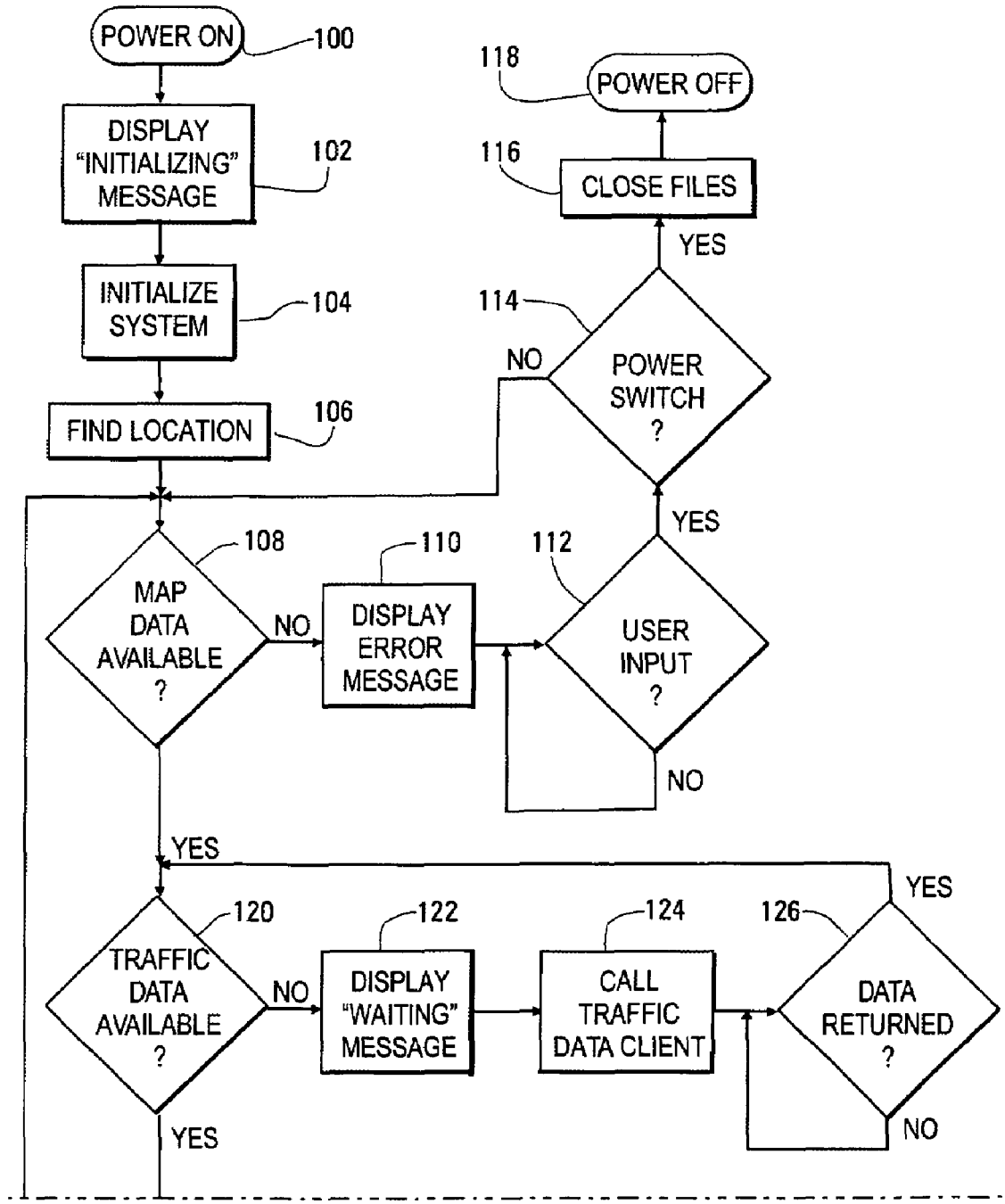
Figure 7B:
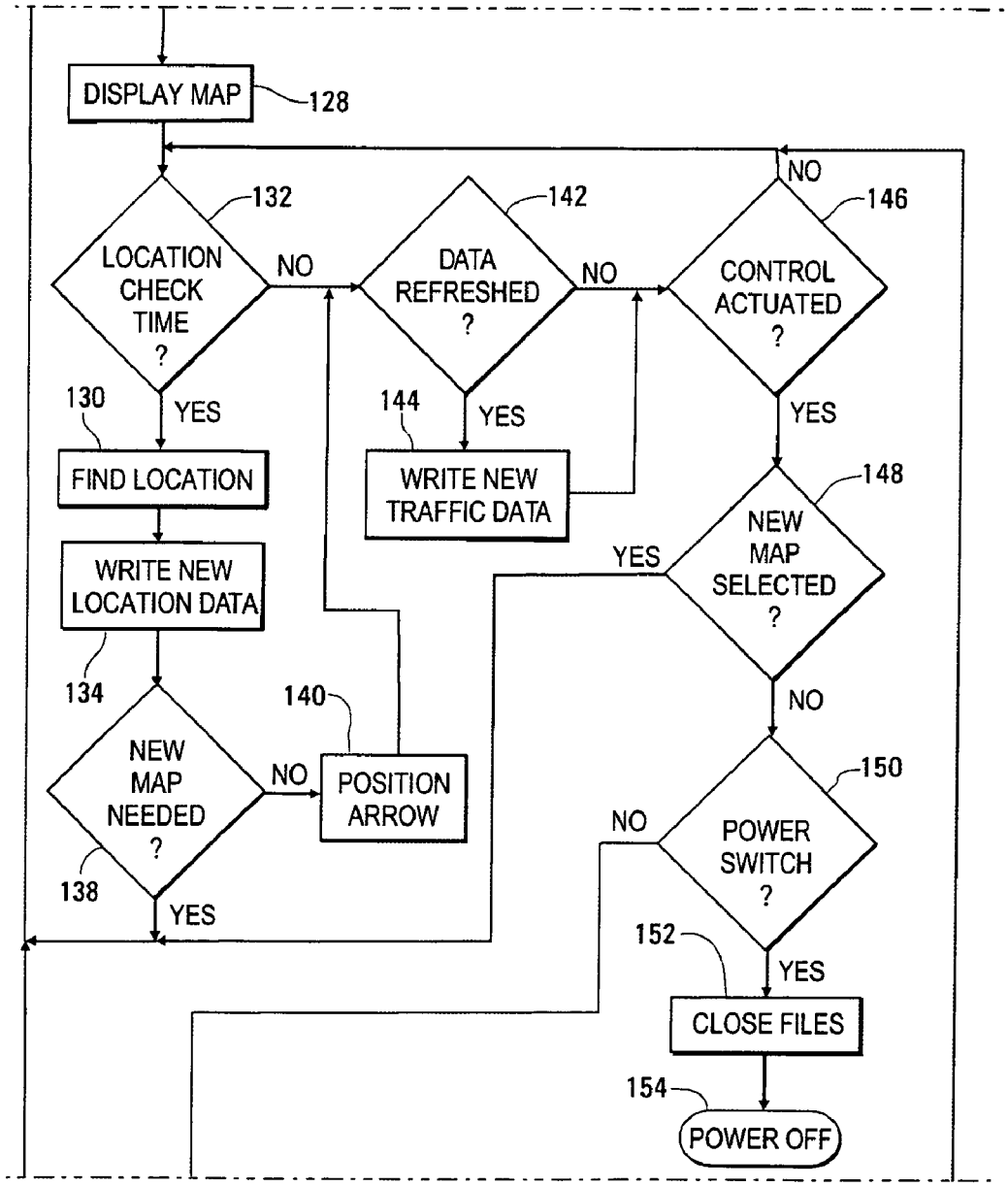
Figure 7C:
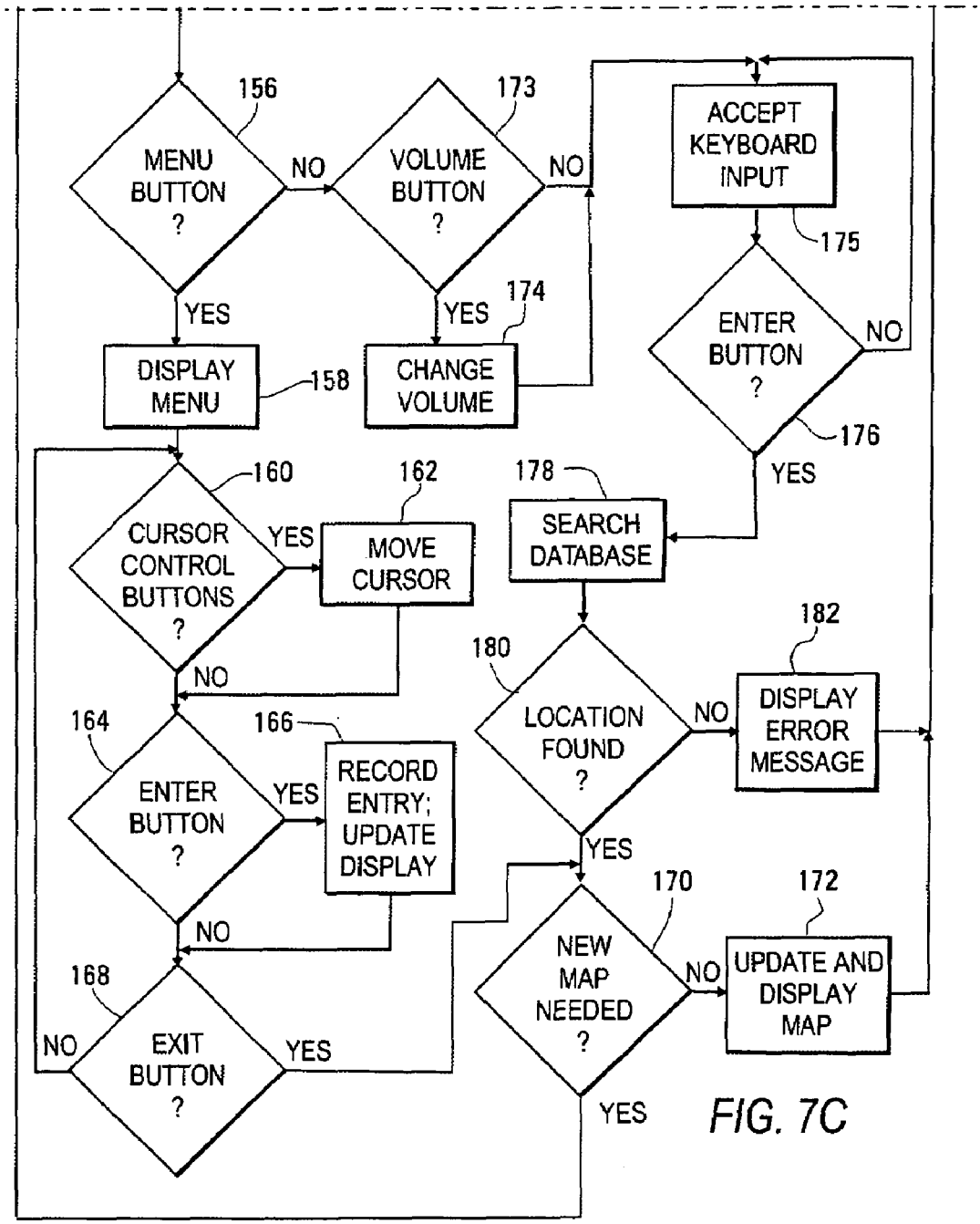

FIG. 7 is a flow chart of processes occurring within the traffic information computer 12 in accordance with the invention under control of the navigation program 52. FIG. 7 is divided into an upper section, indicated as FIG. 7A, a middle section, indicated as FIG. 7B, and a lower section, indicated as FIG. 7C.

Referring to FIGS. 2, 3 and 7, after the computer 12 is turned on in step 100 by depressing the power switch 61, an initializing message, saying, for example, "Please wait," is displayed in step 102, as the computer system initializes in step 104, loading programs needed for operation. When this process is completed, the present location and direction of the vehicle 10 is determined from the output of the GPS receiver 48 through the GPS interface 44. From this point, the system enters a subroutine to display a map of an area including the location of the vehicle. First, in step 108, a determination is made of whether the data is available within the mapping database 56. If this data is not available, an error message is displayed in step 110, while the system waits to determine whether a user input has occurred in step 112. For example, the user may decide that he is outside the region for which he has data, and that he will turn the system off until he returns to such a region. Thus, if the power switch 61 is depressed, as determined in step 114, the system proceeds in step 116 to close files that have been opened before turning the power off in step 118. Other actions may be taken by the user, such as using the zoom button 73 to choose a display with less detail or loading a removable medium 38 to provide more traffic data. Thus, if the user performs an input other than the depression of the power switch 61, as determined in step 114, the system returns to step 108 to determine if the map data is available.

If it is determined in step 108 that the map data needed is available, the system proceeds to step 120 to determine whether traffic data for the map to be displayed is available within the traffic database 58. The traffic database 58 may include a field indicating when each traffic data value has been recorded, with the process of determining whether traffic data is available including a determination of whether the data has been written recently enough that it should be considered timely. If it is determined in step 120 that the needed traffic data is not available, the system displays a "waiting" message in step 122, indicating that it is waiting to receive traffic data. The navigation program 52 then calls the traffic data client 54 in step 124 to obtain the necessary traffic data. In a manner to be described in detail in reference to FIG. 8, the traffic data client 54 obtains the data from the traffic data server 22, writes the new data to the traffic database 58, and returns a code to the navigation program 52. When this code has been returned, as determined in step 126, the system returns to step 120 to determine if the required traffic data is now available.

After it is determined in step 120 that the traffic data needed for display on the map is available, the system displays the map in step 128 Then, the system enters a loop in which it is determined whether an event that may cause a change in the map being displayed. The first such event is the movement of the vehicle 10. To determine the position of the vehicle 10, the output of the GPS receiver 46 is examined in step 130 through the GPS interface 44 whenever it is determined in step 132 that a time has arrived to check the vehicle location. Then, in step 134, data describing the new location is written to a location data structure 136 within RAM memory 28. Then, in step 138, a determination is made of whether the movement of the vehicle 10 has been sufficient to require the display of a new map. If a new map is needed, the system returns to step 108 to determine if the data to generate the new map is available. If a new map is not needed, the arrow representing the position of the vehicle is repositioned on the map in step 140. In general, this arrow is displayed on one of the roadways shown in the map, at a location determined by the location data, with the arrow being moved along the roadway until it has moved far enough to cause the display of a new map. The arrow may be maintained near the center of the displayed map, or most of the displayed map may be provided to show roadways toward which the vehicle is heading.

The traffic data client 54 obtains new traffic data on a periodic basis, refreshing the traffic data stored within the traffic database 56. When this occurs, the traffic data client 54 returns a code to the navigation program 52 indicating that the data has been refreshed. When it is determined in step 142 that this has occurred, new traffic data is written to the displayed map in step 144.

The user may also change information displayed on the screen 34 by operating one of the controls 42. If it is determined in step 146 that the user has operated one of the controls, the system proceeds to step 148, in which a further determination is made of whether one of the controls selecting a new map has been operated. For example, the depression of the zoom buttons 72, 73, the DISP button 84 results in the selection of a new map to be displayed, as determined in step 148, causing the system to return to step 108 to determine whether map data is available for the new map.

If a control is actuated without selecting a new map, the system proceeds to step 150, in which it is determined whether the power switch has been depressed. If it has, the open files are closed in step 152, and the power is shut off in step 154.

If it is determined in step 150 that the power switch 61 was not depressed, the system proceeds to step 156, in which it is determined whether the menu button 86 has been depressed. If it has, the menu is displayed in step 158, with the system entering a loop to respond to the depression of another control button. Then, if a cursor control button, such as one of the zoom buttons 72, 73, is depressed, as determined in step 160, the cursor is moved on the screen, in step 162, in the direction of movement associated with the button that is depressed. When it is determined in step 164 that the enter button has been depressed, data corresponding to the entry is recorded in the configuration data 59, with the menu display being updated by the placement of a marking in the checkbox 88 that has been selected, and with markings being removed from any conflicting checkboxes. When it is determined in step 168 that the exit button 92 has been depressed, the system proceeds to step 170, in which it is determined whether a new map is needed due to the changes that have been made. If it is, the system returns to step 108 to determine whether map data is available for the new map. Otherwise, the map previously displayed is updated and displayed again in step 172.

If it is determined in step 156 that the menu button has not been depressed, the system proceeds to step 173, in which a determination is made of whether the volume button 98 has been depressed. If it has, a volume level adjustment for subsequent audio messages is changed in step 174, being increased, for example, in incremental levels among six volume levels and then returned to the lowest volume level.

If it is determined in step 171 that the menu button 86 has not been depressed, it is assumed that either the find button 94 or the route button 97 has been depressed, so the system proceeds to step 175 to accept input from the keyboard 96 until a determination is made in step 176 that the enter button 90 has been depressed. Then, in step 178, the mapping database 56 is searched to find the location having an address entered by the user with the keyboard 96. If this location is not found, as determined in step 180, an error message is displayed in step 182, with the system returning to step 184 to wait for another operator action. For example, the user may correct his keyboard input to begin another search operation. If the location of the address provided by the user as an input in step 175 is found, the system proceeds to display a map including a highlighted route between the user's present location and the location of the address provided in step 175, if the route button has been depressed. Alternately, if the find button has been depressed, the system proceeds to display a map in which the location of the address provided in step 175 is highlighted or identified by an icon. If this process requires a new map, the system returns to step 108 to determine if the map data is available for the new map. Otherwise, the new information is added to the presently-displayed map in step 172.

Figure 8A:
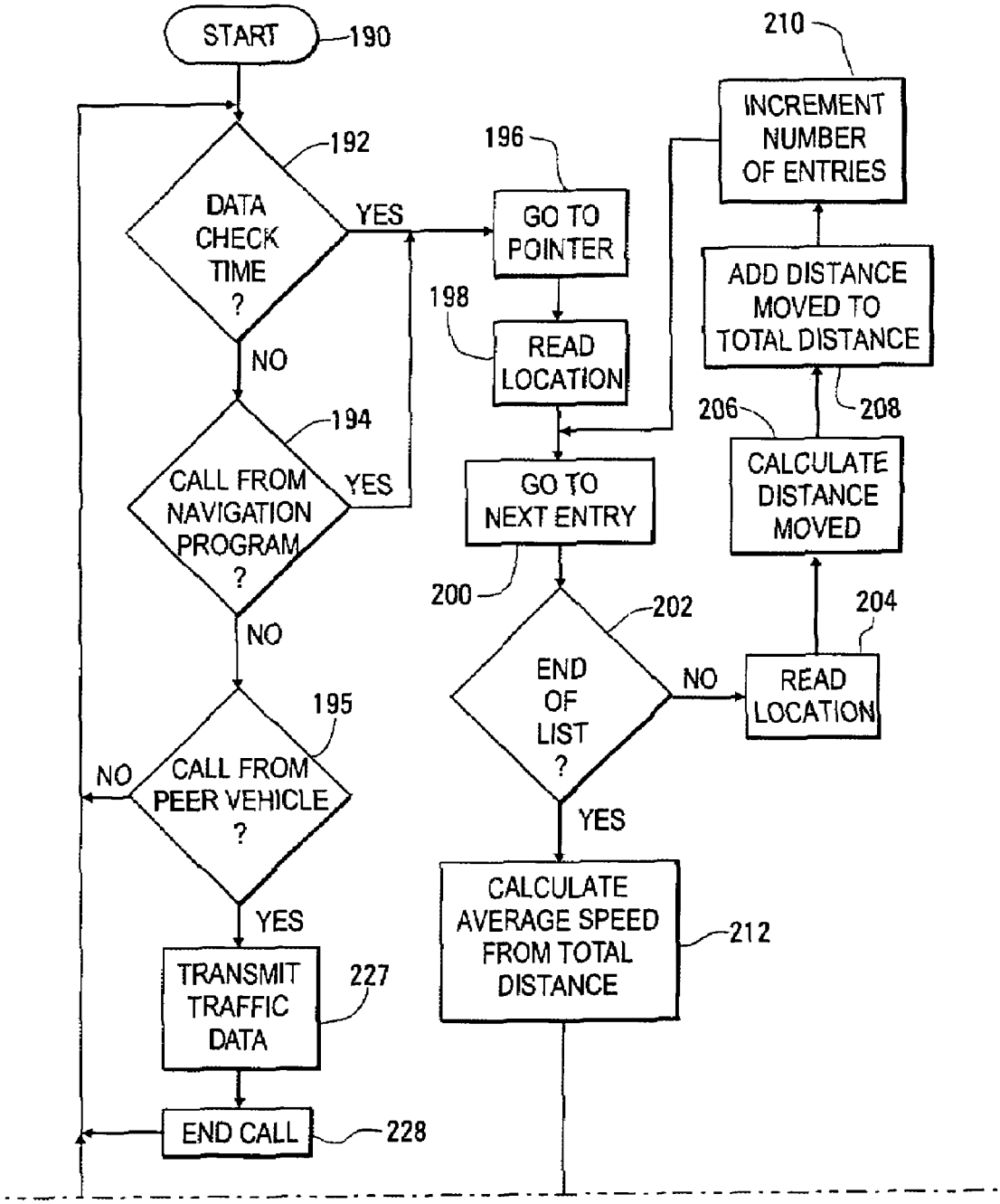
FIG. 8 is a flow chart of a process occurring within the traffic information computer of FIG. 2 during execution of a traffic data client subroutine, including an upper portion indicated as FIG. 8A and a lower portion indicated as FIG. 8B.
Figure 8B:
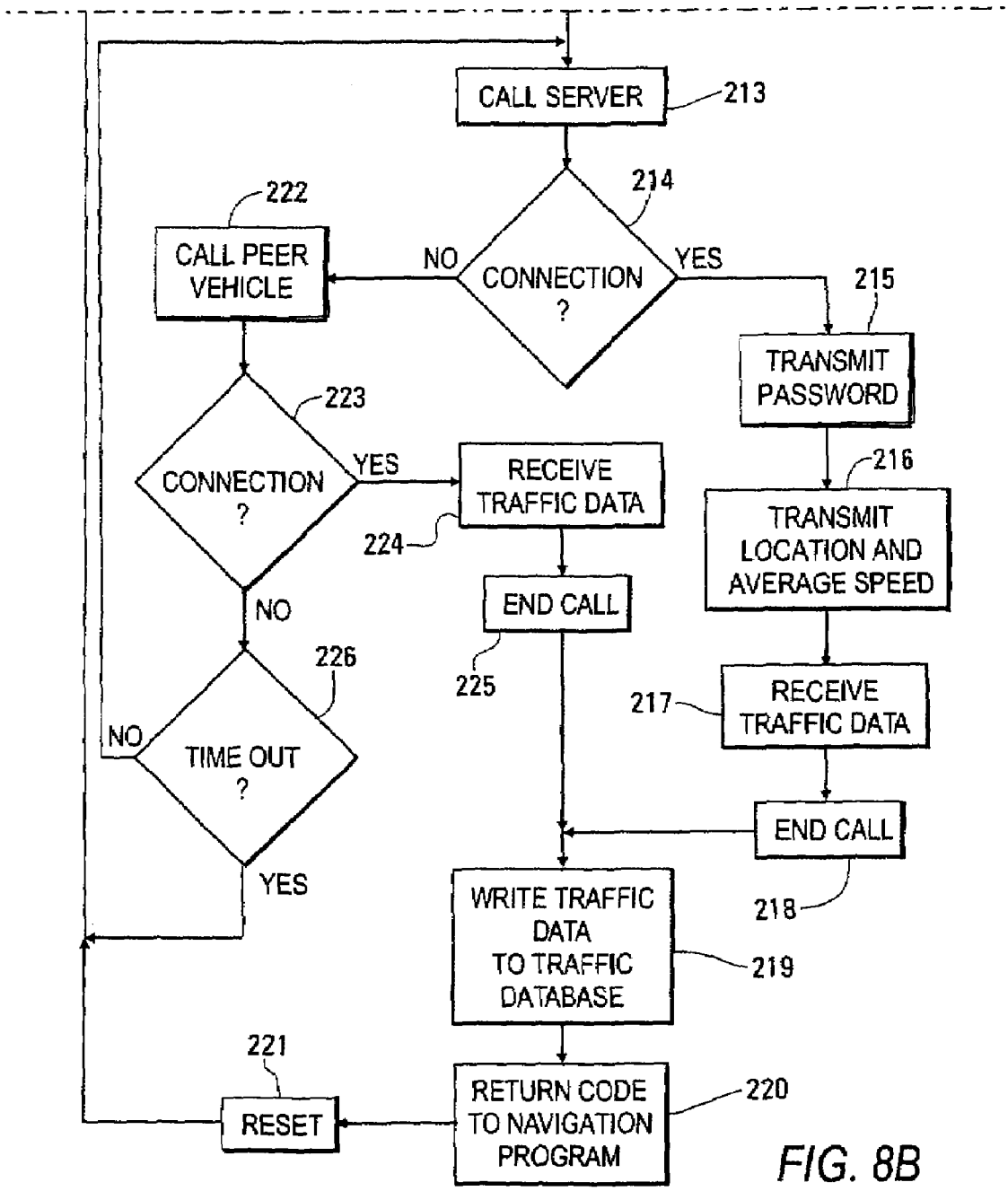

FIG. 8 is a flow chart showing operation of the traffic data control computer 10 under control of the traffic data client subroutine 54, which preferably executes within the microprocessor 24 in a multitasking environment, along with the navigation program 52. FIG. 8 comprises an upper section, indicated as FIG. 8A, and a lower section, indicated as FIG. 8B. The traffic data client subroutine 54 starts in step 190, which occurs during system initialization in step 104 (shown in FIG. 7). The traffic data client subroutine 54 is ended as files are closed in steps 116, 152 (also shown in FIG. 7).

Referring to FIGS. 2, 7, and 8, after starting in step 190, the traffic data client subroutine 54 updates traffic data stored within the traffic database 58 on a periodic basis, according to a data update time as determined in step 192. Otherwise, this subroutine 54 waits for a call from the navigation program 52, as determined in step 194, and for a peer-to-peer call from another vehicle, as determined in step 195. A call from the navigation program 52 is issued in step 124, as explained above in reference to FIG. 7, in response to a determination that the traffic data needed to display a map is not present within the traffic database 58.

In response to either a determination in step 192 that the data check time has arrived, or in response to a call from the navigation program, as determined in step 194, the client subroutine 54 proceeds to determine an average speed at which the vehicle 10 has traveled since the last contact between the system and the traffic data server 22 (shown in FIG. 1). To do this, the client subroutine 54 examines data stored within the location data structure 136. This data comprises a list of locations periodically written to this data structure 136 by the navigation program 52 in step 134, as explained above in reference to FIG. 7. Since this data is written on a periodic basis, the time between sequentially adjacent location entries is known, and an average speed can be calculated from the distance traveled between such entries, or among a plurality of such entries. The data entry occurring before the last contact with the traffic data server 22 is identified by a pointer stored within the location data structure 136.

Thus, the process of determining an average speed is begun in step 196 by going to the data entry identified by the pointer. Next, in step 198, the location stored within this data entry is read. Then, in step 200, the client subroutine 54 goes to the next entry in the location data structure 136. Each time the client subroutine 54 goes to a new entry beyond the entry located by the pointer, a determination is made in step 202 of whether the end of the list in the location data structure 136 has been found. If it has not, a new location identified in the entry is read in step 204. Then, in step 206, the distance moved between the location identified in the most recently read entry and the location read in the previously read entry is calculated. For example, this distance moved may be calculated as the straight-line distance between the two locations. Next, in step 208, the distance moved is added to a total distance, which reflects the distance traveled since the last contact between the client subroutine 54 and the traffic server 22. Next, in step 210, a number of entries, indicating the number of location distances moved that have been added to form the total distance is incremented. Then, the client subroutine 54 returns to step 200 to go to the next entry.

In response to a determination in step 202 that the end of the list within the location data structure 136 has been reached, the average speed is calculated in step 212, with the total distance calculated by multiple summations in step 208 being divided by the time, as evidenced by the number of entries determined in step 210. Preferably a constant is further applied, with consideration of the time between the periodic determination of locations, so that the average speed is expressed in a convenient unit, such as miles per hour or kilometers per hour.

If the vehicle 10 has remained motionless, an average speed of zero is reported, based on an assumption that the vehicle 10 has been sitting in a traffic jam. However, in the first communication with the traffic data server 22, which is needed to obtain initial traffic information, which occurs with only one entry listed in the location data structure 136 a code indicating that an average speed could not be determined will be communicated.

Next, in step 213, the client subroutine 54 calls the traffic data server 22, using the communications adapter 48 and the cellular transceiver 50. If a connection is successfully established, as then determined in step 214, a password identifying the traffic data computer 12 is transmitted to the traffic data server 22 in step 215. Then, in step 216, the vehicle location described in the last entry of the location data structure 136 and the average speed calculated in step 212 is transmitted. Next, in step 217, traffic data information associated with the location transmitted in step 216 is received from the traffic data server 22. After this data has been received, the call is ended in step 218. Then, in step 219, the traffic data received in step 217 is written to the traffic database 58. Next, in step 220, the client subroutine 54 returns a code to the navigation program 52. This code is used, as previously described in reference to FIG. 7, to indicate that data called for has been returned in step 126, or that data for updating maps is available in step 142. Then, in step 221, the traffic data client subroutine 54 resets data used in calculations, with the total distance and the number of entries being set to zero, and with the pointer being moved to the end of the list in the location data structure 136. Finally, the client subroutine 54 returns to step 192 to wait for the next data check time or the next call from the navigation program or from a peer vehicle.

If it is determined in step 214 that a connection has not been made with the server system 22, the traffic data client subroutine 54 attempts to call a peer vehicle 61 in step 222, using the peer-to-peer transceiver 62, driven through the peer-to-peer adapter circuit 63. If the attempt to establish contact with a peer vehicle 61 is successful, as determined in step 223, the traffic data client subroutine 54 receives traffic data from the peer vehicle computer 60 in step 224. When this process is complete, the client subroutine 54 ends the call in step 225 and proceeds to step 219 to write the new information to the traffic database 58. The client subroutine 54 then returns a code to the navigation program in step 220, resets parameters in step 221, and returns to step 192.

If the traffic data client subroutine 54 fails to establish a connection with a peer vehicle 61, as indicated in step 223, a further determination is made in step 226 of whether the process of attempting to make a connection has been timed out.

If it has not, the client subroutine 54 returns to step 213 to make another attempt to call the traffic data server 22, followed, if necessary, by another attempt to call a peer vehicle 61. When the process times out, as defined as reaching a predetermined time or, alternately, as having made a predetermined number of unsuccessful attempts, the client subroutine 54 proceeds from step 226 to step 192.

If a the traffic data client subroutine 54 receives a call from a peer vehicle 61, as determined in step 195, the client subroutine 54 transmits the data stored within its traffic database 58 to the peer vehicle 61 in step 227 and the ends the call in step 228.

Thus, the capability to establish peer-to-peer communications is used as a back-up traffic data source in the event that communications cannot be established with the traffic data server 22. For example, such a failure can occur while traveling in a location too far from the nearest cellular tower 16 or in a location where too many cellular devices are already using the nearest cellular tower 16.

Nevertheless, peer-to-peer communication is understood to be an optional feature of the traffic data computer 12. If the system is not equipped with this feature, the client subroutine 54 makes repeated attempts to contact the traffic data server 22 when such attempts are required until a time-out condition is reached, and the client subroutine 54 returns to step 192 when it is determined in step 194 that a call from the navigation program 52 has not been received.

FIG. 9 is a pictographic view of a data structure 230 within a traffic database 232 accessed by the traffic data server 22 (shown in FIG. 1). The data structure 230 includes a record 234 for each direction of travel on each of the road segments for which traffic data is collected. Each of the records 234 includes a number of fields 236 with a name indicated in the upper line 238 of FIG. 9. The first field 238 includes an alphanumeric code representing the particular road segment for which data is listed within the entry 234. The second field 240 includes a number representing the calculated average speed of vehicles reporting their movement along this road segment. The third field 242 includes a number representing a normal speed for the road segment. The fourth field 244 includes an alphanumeric code representing a color that will be displayed as described above in reference to FIGS. 3 and 4 to indicate a relationship between the average speed of vehicles and the normal speed of vehicles. The remaining fields include time fields 246 storing numbers indicating the times at which reports are received from individual vehicles 10 and speed fields 248 storing the speeds reported by the vehicles 10 at the time indicated by within the adjacent time fields 246.

As traffic data clients 54 call the traffic data server 22 to provide and receive traffic information, the time fields 246 and associated speed fields 248 of various records 234 are filled with data. Fields that are not filled retain null values. When a record includes one or more null fields, new time and speed data are written to null fields. If there are no null fields, such data is preferably written over the oldest data stored within the record. On a periodic basis, data within the data structure 30 is refreshed by calculating a new average speed, to be written in the average speed field 240 of each record 234, with the average speed being calculated as the average of the data in the speed fields 248 associated with times, recorded in the associated time fields 246, that indicate a time for relevance of the data has not expired. If this time has expired, the time and speed data is overwritten or erased to leave fields having null values. The traffic database further includes a means for relating various of the records 234 with one another, so that, when a client calling from a vehicle 10 transmits his location, detailed traffic data for an area surrounding his location can be returned to him, along with data for main roads in a larger region. Such a means may be provided through another table identifying records as being related to one another or by organizing the table 230 into sections, with one section including records 234 for main roads, having data to be returned to all calling vehicles, and with other sections including detailed records to be returned only to vehicles calling from a location within or adjacent to each of the sections.

Figure 10A:
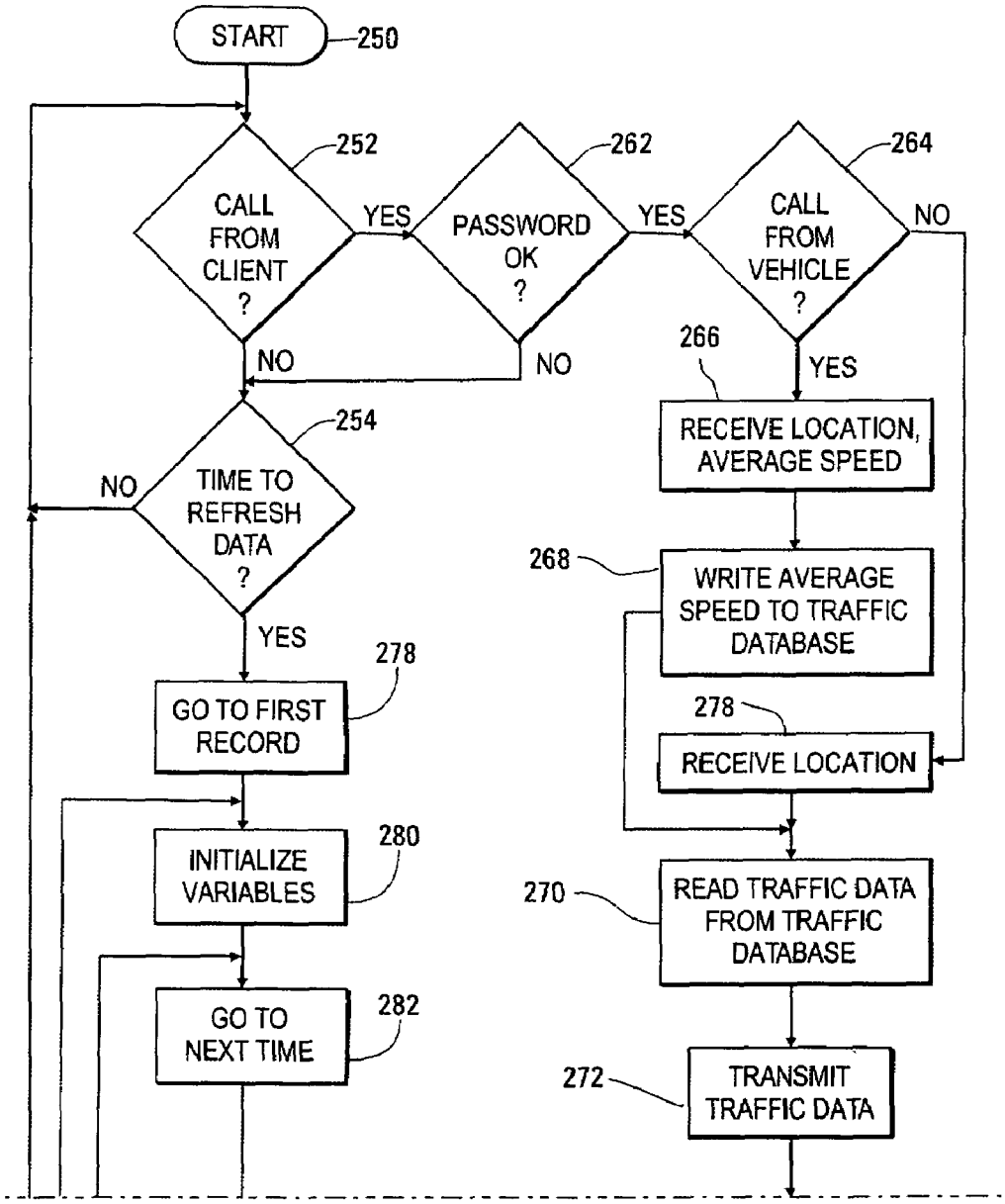
FIG. 10 is a flow chart of processes occurring within the traffic data server within the traffic information system of FIG. 1, including an upper portion indicated as FIG. 10A and a lower portion indicated as FIG. 10B.
Figure 10B:
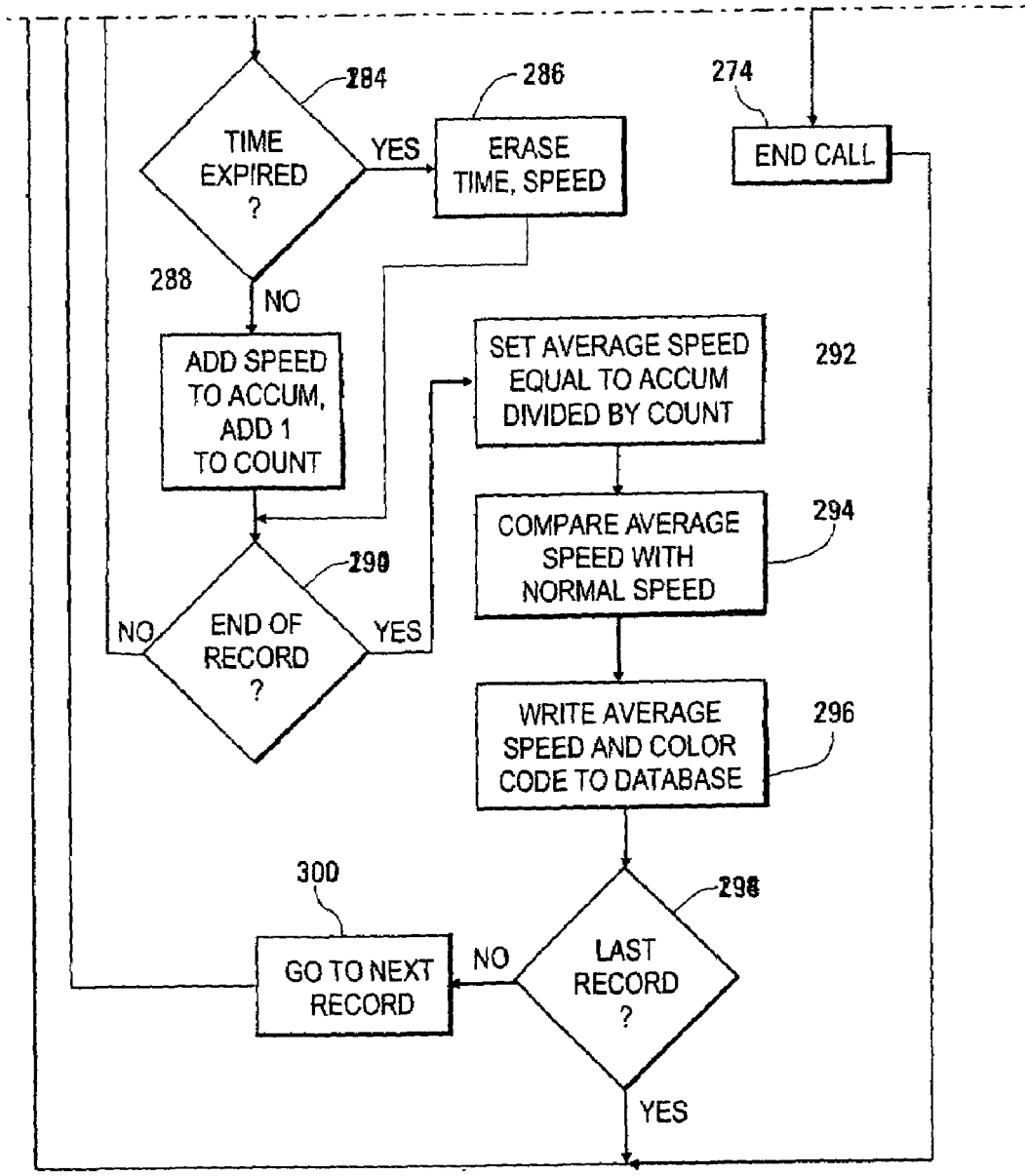

FIG. 10 is a flow chart showing processes occurring within the traffic data server 22 of FIG. 1. FIG. 10 includes an upper section, indicated as FIG. 10A, and a lower section, indicated as FIG. 10B. After starting in step 250, the server system enters a loop in which a determination is made in step 252 of whether a call has been received from a client, and further in which a determination is made in step 254 of whether a time has been reached for periodically refreshing the data stored in the traffic database 232

Referring to FIGS. 1 and 10, the traffic data server 22 provides data for a number of clients executing in traffic data computers 12 within vehicles 10 in the manner described in detail above. According to a preferred version of the invention, the traffic data server 22 additionally provides data for a number of clients executing within personal computers 256 connected to the Internet 20 in a conventional manner, such as by means of the public switched telephone network 18. Each of these personal computers 256 executes programs generally as described above to obtain traffic data from the traffic data server 22 and to display the data as described particularly in reference to FIGS. 3 and 4. Various of the keys of the standard keyboard 258 of the personal computer 256, such as the function keys F1-F12 are assigned the functions described above in reference to FIG. 3. While the personal computer 256 does not transmit its location and speed, it can be used to describe a location for which traffic data is needed, and can move along maps using the keys assigned the zoom and navigate key functions.

Additionally in accordance with a version of the invention, the various client systems each have a password, which is stored in a client database 260. The use of a password, which can be automatically presented by the client, restricts access, for example, to individuals paying fees to cover the cost of operation.

Referring to FIGS. 9 and 10, when a determination is made in step 252 that a call has been received from a client, a password presented by the client is checked in step 262. If the password is not correctly given, the system terminates the call and returns to step 254 to continue waiting for a time to refresh data or for another call from a client. If it is determined in step 262 that the password is correct, a determination is made in step 264 of whether the call is from a vehicle 10 or from a personal computer 256. For example, this determination may be based on a different series of passwords being assigned to personal computers 256 and traffic data clients 54 within vehicles 10. If the call is from a vehicle, location and average speed data is received in step 266. Then, in step 268, the time and average speed transmitted by the traffic data client 54 within the vehicle 10 is recorded in the client database 260 within a record 234 corresponding to the location also transmitted by the traffic data client 54. If there are null values among the time and speed fields 246, 248 within this record, the data is written over a pair of such null values. Otherwise, the time and speed data is preferably written over the oldest time and speed data within the record 234.

Then, in step 270, traffic data from records associated with the record 234 corresponding to the location of the vehicle 10 is read from the traffic database 232. Preferably, this traffic data includes average speed data from field 240 and a color code from field 242 for each road segment in an area surrounding the location of the vehicle 10, together with such data for segments of main roads within a larger area. Next, in step 272, the data read in step 270 is returned to the calling traffic data client 54 placing the call. Finally, in step 274, the call is terminated, with the traffic data server returning to step 252 to wait for another call from a client or for the time to refresh data.

If it is determined in step 264 that the call is from a personal computer 256 instead of from a vehicle 10, the server proceeds to step 276 to receive location data from the personal computer 256. Such data reflects an input from the user indicating the location around which he wishes to receive traffic data. This traffic data is then read from the traffic database in step 270 and transmitted to the personal computer in step 272, with the call being terminated in step 274.

The process of refreshing the data within the traffic database 232 includes the elimination of data that is too old to be considered relevant in determining present traffic conditions and recalculating the average speed for each record 234 in the table 230. Thus, if it is determined in step 254 that the time to refresh data has arrived, the system goes to the first record 234 in step 278. Then, in step 280, variables used in the calculation of an average speed are initialized. Then, in step 282, the server system goes to the time field 246 in which the next time is entered. Time fields 246 having null values are skipped in this process. Next, in step 284, a determination is made of whether a predetermined time limit has expired since data was written in this record to this time field 246. If it has, the data within the time field 246 and in the next speed field 248, which is associated with this time field is erased or overwritten in step 286 to leave a null value. If it is determined in step 284 that the time has not expired, the speed in the next speed field 248 is added to an accumulating variable, and one is added to a counting variable, in step 288.

After step 286 or after step 288, a determination is made in step 290 of whether the time and speed data that has just been considered is at the end of the record. If it is not, the server system returns to step 280 to perform the same process on the next time and speed data in the record. After the last time and speed data in the record has been considered, as determined in step 290, the average speed for the record is calculated in step 292 as the value of the accumulating variable divided by the value of the counting variable. Then, in step 294, the average speed calculated in step 292 is compared to the normal speed for the road section associated with the record 234, with this normal speed being read from the normal speed field 242. The result of this comparison is used to determine a color code to indicate a comparison of the traffic status of the road segment with normal traffic flow conditions for the same road segment. Then, in step 296, the average speed and color code are written to the database 232 in the average speed field 240 and the color code field 244, respectively.

Next, a determination is made in step 298 of whether the record that has just been considered is the last record in the data structure within the traffic database 232 If it is not, the server goes to the next record in step and returns to step 280 to begin the process of refreshing data within the next record. If it is the last record, the process of refreshing data has been completed, so the system returns to step 252 to continue waiting for a call from a client or for the next time to refresh data.

The processes described above for answering client calls and for refreshing data may be carried out by separate routines executing in a multitasking environment within a processor in the traffic data server 22, or by routines executing in separate processors or computing systems both having access to the traffic database 232.

The invention has an advantage over methods of the prior art in that traffic speed data is transmitted to the traffic data computer 12 and displayed directly on the screen 34 to aid the user in determining which road to take. Another advantage of the invention arises from the fact that peer-to-peer communications with another vehicle 61 are used when communications cannot be achieved with the traffic data server 22. Yet another advantage arises from the fact that the number of cellular telephone calls between each vehicle 10 and the traffic data server 22 is minimized, first by accumulating the results of a number of location measurements before placing such a call, and second because data is transmitted in both direction between the vehicle 10 and the traffic data server 22.

While the invention has been shown in its preferred forms or embodiments with some degree of particularity, it is understood that such descriptions have been given only by way of example and that many changes can be made without departing from the spirit and scope of the invention, as described in the appended claims.

What is claimed is:

1. A traffic information computer system comprising:

a data storage database for obtaining data from users and holding said data for generating roadmaps and a traffic database storing average speed data for road segments;

a display screen;

a first transceiver;

a microprocessor programmed to generate roadmaps from data held within said mapping database, to display said roadmaps on said display screen, to receive average speed data for road segments through said first transceiver, to store said average speed data for road segments received through said first transceiver to said traffic database, and to display portions of said average speed data for road segments stored within said traffic database in locations corresponding to said road segments on said display screen;

a location sensor for determining locations of said computer system as said computer system is moved along with a vehicle, wherein said microprocessor is additionally programmed to calculate periodically an average speed of movement in response to location data provided by said location sensor at a number of predetermined times and to transmit said average speed of movement over said first transceiver; and wherein said microprocessor is additionally programmed to display an icon on a road segment displayed on said display screen in a location corresponding with a location indicated by an output of said location sensor and in an orientation indicating a direction of travel of said traffic information computer system.

2. The traffic information control system of claim 1, wherein said traffic database stores different average speed data for opposite directions of travel for certain of said road segments, said microprocessor is programmed to display said different average speed data within adjacent icons in locations corresponding to said road segments on said display screen, and said adjacent icons are placed side by side, with an icon on the right side indicating an average speed in said direction of travel of said traffic information computer.

3. The traffic information computer system of claim 1, wherein said microprocessor is additionally programmed to vary a displayed portion of said roadmaps displayed on said display screen in response to movement of said traffic information computer system.

4. The traffic information computer system of claim 3, additionally comprising controls operable by a user of said information computer system, wherein said microprocessor is additionally programmed to vary said displayed portion of said roadmaps displayed on said display screen in response to operation of said controls.

5. The traffic information computer system of claim 4, wherein said controls include a navigation control and a zoom control, said microprocessor is additionally programmed to vary said displayed portion of said roadmaps displayed on said display screen to effect movement of said displayed portion in a direction determined by operation of said navigation control, and to vary said displayed portion between a highly detailed display of a first region to a less detailed display of a region much larger than said first region in response to operation of said zoom control, and said less detailed display shows only main roads and traffic data associated with said main roads.

6. The traffic information computer system of claim 4, wherein said controls additionally include a keyboard for entering an address, and said microprocessor is additionally programmed to accept an input from said keyboard, to determine a location corresponding to an address provided by said input from said keyboard, and to display an indication of said location corresponding to said address on a roadmap displayed on said display screen.

7. The traffic information computer system of claim 6, wherein said microprocessor is additionally programmed to determine a route along roads between said location indicated by said location sensor and said location corresponding to said address, and to display an indication of said route on a roadmap displayed on said display screen.

8. The traffic information control system of claim 1, further comprising at least one additional traffic information computer system located in at least one other vehicle in order to exchange said data.

9. The traffic information control system of claim 1, further comprising a second database storing average data values, a second transceiver for transmitting said average data values to another vehicle and for receiving said average data values from another vehicle within said plurality of vehicles, and traffic information computer including a microprocessor programmed to determine said traffic data from geographic location data received from said location sensor, to transmit said traffic data determined form data received from said location sensor over said communication network to said traffic information server, to receive said average data values over said communication network from said traffic information server, and to transmit and receive said traffic data values from another vehicle within said plurality of vehicles through said second transceiver.

10. The traffic information control system of claim 1, wherein said microprocessor in said traffic information computer is additionally programmed to determine whether a connection can be made over said communication network with said traffic information server and, in response to a determination that said connection cannot be made over said communication network, to establish a connection with another vehicle in said plurality of vehicles through said second transceiver to receive said average data values.

11. The traffic information control system of claim 1, wherein said microprocessor in said traffic information computer is programmed to transmit said traffic data and to receive said average data values in a single call to said traffic information server, and said processor in said traffic information server is programmed to receive said traffic data from a vehicle in said plurality of vehicles and to transmit said average data values to said vehicle in single call.

12. The traffic information control system of claim 1, wherein said communication network includes:

an Internet connection, a public switched telephone network, and a cellular tower connecting said first transceiver to said public switched network.

13. The traffic information control system of claim 1 additionally comprising a personal computer connected to said traffic information server over said communication network to receive said average data values from said traffic information server.

14. The traffic information control system of claim 1, wherein said traffic data comprises an average speed of said vehicle, said processor within said traffic information server is programmed to calculate average data values comprising averages of speeds of a number of vehicles over particular road segments, said average data values comprise averages of speeds of a number of vehicles over particular segments of road.

15. The traffic information control system of claim 14, wherein said processor within said traffic information server is additionally programmed to calculate values comparing said averages of speeds of a number of vehicles over particular road segments with normal speeds of vehicles over said particular road segments, and said average data values additionally comprise codes representing said values comparing said averages of speeds with said normal speeds.

16. The traffic information control system of claim 1, wherein said microprocessor is programmed to transmit said average speed of movement and to receive said average speed data for road segments in a single call placed over said first transceiver.

* * * * *